United States Patent [19]

Yoshiharu

[11] 3,962,979

[45] June 15, 1976

[54] SEWING MACHINE

[76] Inventor: Yazaki Yoshiharu, 4-11, Shiniuku 1-chome, Shinjuku, Tokyo, Japan

[22] Filed: Jan. 14, 1975

[21] Appl. No.: 541,063

[52] U.S. Cl. ..... 112/98; 112/158 R
[51] Int. Cl.[2] ..... D05C 3/02
[58] Field of Search ..... 112/98, 100, 439, 158 R

[56] References Cited

UNITED STATES PATENTS

| | | | |
|---|---|---|---|
| 3,216,385 | 11/1965 | Kojima et al. | 112/158 R |
| 3,316,868 | 5/1967 | Eguchi | 112/158 R |
| 3,369,510 | 2/1968 | Taketomi | 112/158 R |
| 3,512,491 | 5/1970 | Heimann et al. | 112/252 |
| 3,847,101 | 11/1974 | Tolle | 112/252 |

*Primary Examiner*—Alfred R. Guest
*Attorney, Agent, or Firm*—Toren, McGeady and Stanger

[57] ABSTRACT

A sewing machine in which a needle bar for an underthread is provided below a bed and is vertically and laterally reciprocable, and in which a spool means provided above the bed and wound up with an embroidery thread supplies the thread under tension and in which a control means is provided for the tension means to limit the lateral movement of the tension means, with a take-up means being provided below the bed.

3 Claims, 11 Drawing Figures

SEWING MACHINE

This invention relates to a sewing machine, and more concretely, a machine by which a desired pattern can be sewn on a cloth in a manner like embroidery.

In conventional embroidery, embroidery threads appear even on the back surface of cloth which is not required to be decorated by embroidery threads, whereby substantial waste of threads occurs and consequently the cloth embroidered thereby becomes expensive. Especially, when gold or silver threads are used as embroidery threads, the back of cloth becomes very thick. It is easily conceivable that when a thick embroidery thread is used, a needle needs to be relatively thick. Inasmuch as a thick needle damages a cloth, the thickness of the embroidery thread involves a limitation. And, also since an embroidery thread must be passed through the cloth in conventional embroidery, the use of a thread having knots, a thread twisted with other threads such as gold or silver threads, or a thread having a low tensile strength, is practically impossible.

In view of the above, it is an object of this invention to provide a machine which can minimize the amount of embroidery threads required and consequently can produce decorative patterns on a cloth considerably lower in cost when compared to conventional embroidery.

It is another object of this invention to provide a machine, in which thick threads which are considered not useable in conventional embroidery may be employed, and in which a cloth can be decorated by embroidery patterns without being damaged and wrinkled.

It is a further object of this invention to provide a sewing machine, by which embroidery decorative patterns may be produced even by employing knotted threads, threads of low tensile strength or threads twisted with other threads.

In the drawing in which an embodiment of the machine made in accordance with the present invention is illustrated:

Figure 10A:
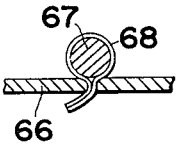
Figure 10B:
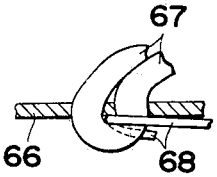

FIGS. 10*a* and 10*b* are enlarged explanatory views of products obtained by the machine.

Figure 1:
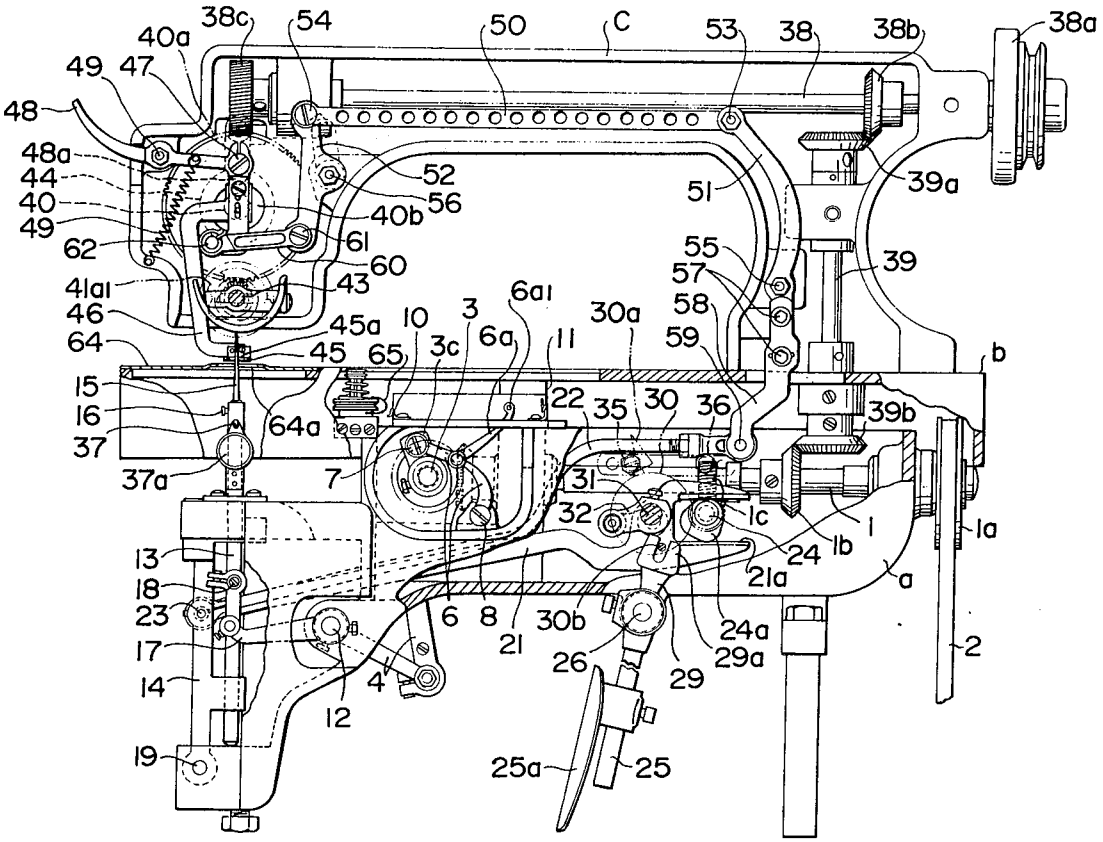
FIG. 1 shows a front view of the machine with parts cut open.
Figure 2:
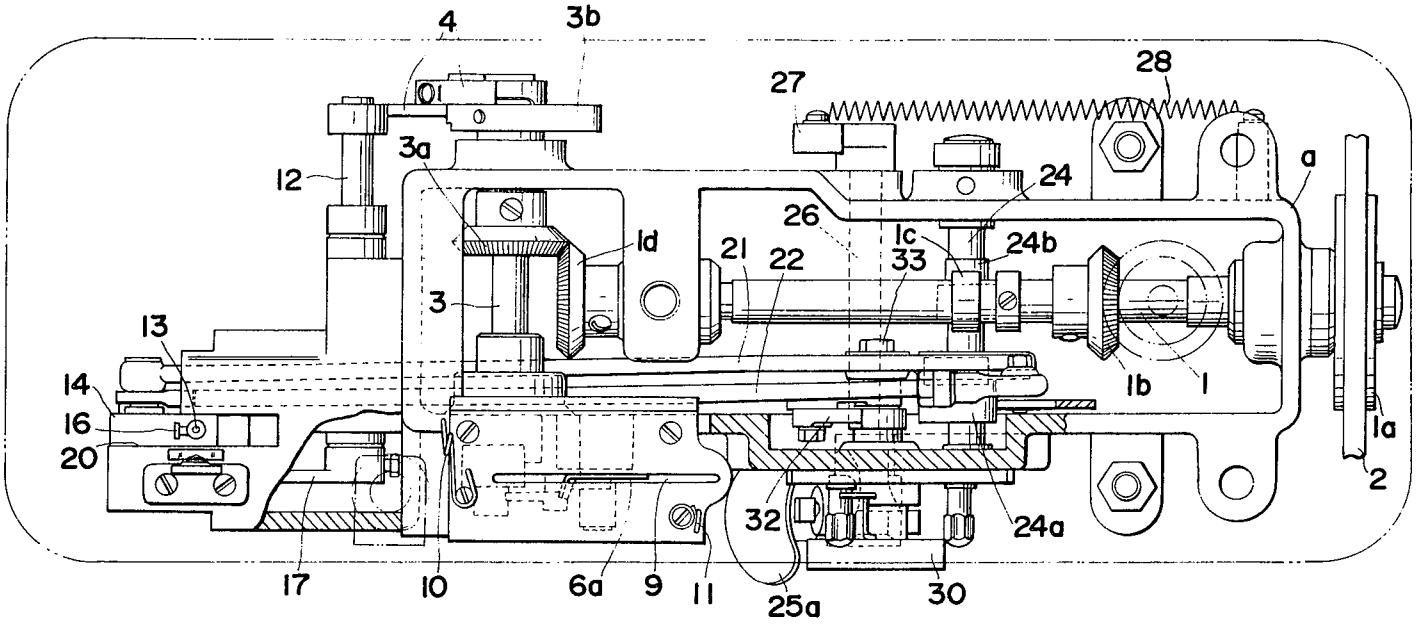
FIG. 2 is a plan view of an under-frame and mechanisms provided thereto.
Figure 3:
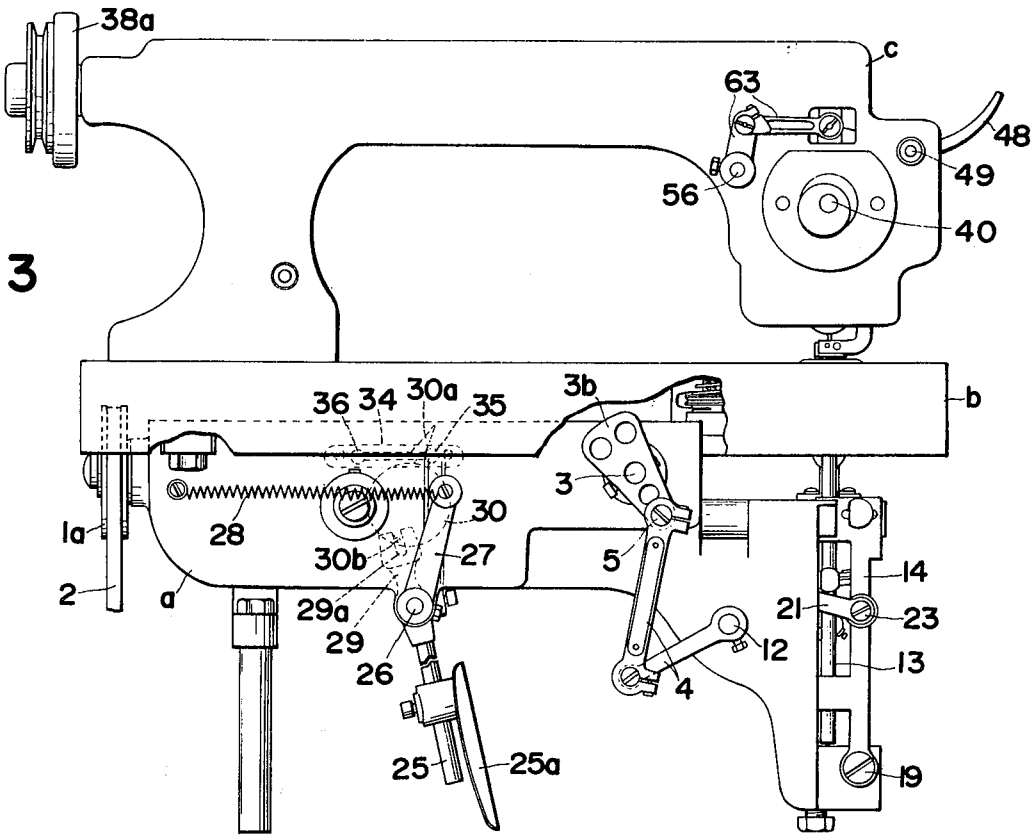
FIG. 3 is a back view of FIG. 1.

First, with reference to FIGS. 1, 2, and 3, letter *a* indicates an under-frame, within which and at upper horizontal portion of which there extends a lower main shaft 1 which consists of a grooved wheel 1*a*, bevel gear 1*b*, worm gear 1*c* and another bevel gear 1*d*. The driven power is given to said shaft by a belt 2 mounted over the grooved wheel 1*a* and driven by an electric motor, not shown. Numeral 3 indicates a driven shaft which consists of a bevel gear 3*a* meshing with the aforementioned bevel gear 1*d*, an operating plate 3*b*, and an operating lug 3*c*. To one end of said plate 3*b*, there is rotatably fixed by a shaft 5 one end of larger crank 4, and to the end of operating lug 3*c* there is fixed one end of a smaller crank 6 having an under-thread feed lever 6*a* and rotatable about a pin 7. Another end of said smaller crank 6 is rotatably fixed to the under-frame *a* by a pin 8, and the thread feed lever has an eye $6a_1$ adjacent to the free end thereof. The under-frame *a* has, above the thread feed lever 6*a*, a slot 9 which allows said lever to project outwardly from the frame, and a pair of loops 10, 11 are provided adjacently to the ends of said slot for guiding the thread.

Another end of the larger crank 4 is fitted to a rotary shaft 12. Numeral 13 indicates a bar for vertically reciprocating a needle 15, and 14 a rod for guiding the bar 13. The needle 15 which is inserted to the upper part of said bar 13 is firmly clamped thereto by a screw 16. A crank 17 is at its one end rotatably fitted by a shaft 18 to an intermediate portion of the needle reciprocating bar 13 and fixedly fitted at another end to the shaft 12. The guide rod 14 in which the needle reciprocating bar 13 is slidably mounted, can incline at its lower end about a pin 19 to the left or right in FIG. 1, and is also supported at its upper portion by a slot 20 of the under-frame *a*.

Numeral 21 indicates a lever for laterally moving the needle, and numeral 22 a lever for laterally moving an upper thread spool. One of the ends of each of said two levers is pivoted by a shaft 23 to the intermediate portion of the needle guide rod 14. The other end of rod 21 is formed with a follower groove 21*a* to which a cam 24*a* fixed to a rotary shaft 24 engages. Said rotary shaft is fitted with a worm wheel 24*b* which in turn engages the worm gear 1*c* of the lower main shaft 1. Further, numeral 25 indicates a lever for regulating a degree of lateral movement of needle, which has a press plate 25*a* and is fixed to a rotary shaft 26. Fixed to another end of the rotary shaft, is a lower part of arm 27, and between the upper part of which and the under-frame *a* a tension spring 28 is pulled so as to bias the lever 25 normally in the position shown in FIG. 1. The rotary shaft 26 has at its free end a bifurcated portion 29*a*.

A rotatable disc plate 30 is fixed to an end of a rotary shaft 31 and has a pointer 30*a* and a pin 30*b* which is insertedly supported by the aforementioned bifurcated portion of the rotary shaft 26. To the other end of said rotary shaft 31, an end of crank 32 is fixed, having another end rotatably connected, by means of a shaft 33, to the aforementioned lever 21 which laterally moves the needle. Numeral 34 indicates a scale for the pointer 30*a*, 35 and 36 stoppers for said pointer, and 37 a guide plate for a thread.

Further, with reference to FIGS. 1 to 3, the letter *b* indicates a table fixed upon the under-frame *a*, the letter *c* a head frame provided above the table *b*, and numeral 38 an upper main shaft which has a manual rotary wheel 38*a*, a bevel gear 38*b* and a worm gear 38*c*, said upper main shaft extending horizontally through the head frame *c*. Said bevel gear 38*b* meshes with a bevel gear 39*b* of a vertical shaft 39, and said bevel gear 39*b* in turn meshes with the bevel gear 1*b* of the lower main shaft 1. The aforementioned worm gear 38*c* meshes with a worm wheel 40*a* of a shaft 40 which moves in connection with the rotary movement of said upper main shaft, and the said shaft 40 is fixed at one of its end with a cam 40*b*.

Figure 6:
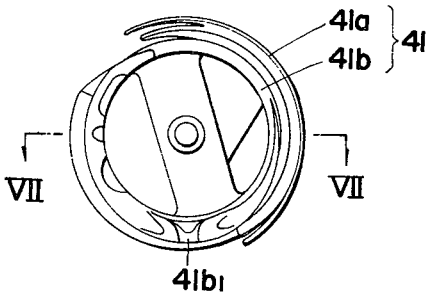
FIG. 6 is a front view of an outer tension or shuttle device.
Figure 8:
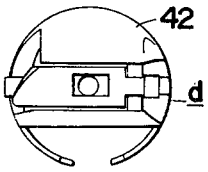
FIG. 8 is a front view of an inner tension or shuttle device.
Figure 7:
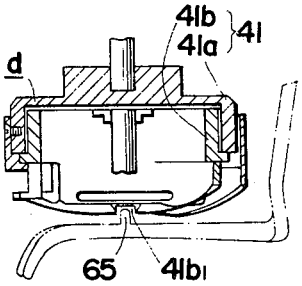
FIG. 7 is a sectional view of said shuttle device, taken along the line VII—VII in FIG. 6.
Figure 9:
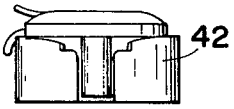
FIG. 9 is a bottom view of FIG. 8.

The numeral *d* indicates tension or shuttle means consisting of an inner body 41 and an outer body 42. A worm gear 43 for rotating a rotary ring 41*a* of the outer body 41 meshes with the aforementioned worm wheel 40*b*. And, as best shown in FIGS. 6 and 7, to the bottom of a stationary ring 41*b* of the outer body 41 there is provided with a slot 41*b*$_1$ such as a V shaped slot for feeding out an embroidery thread. Said outer body 41 is suspended by the shaft 40 by means of a support plate 44, and laterally movable.

Figure 5:
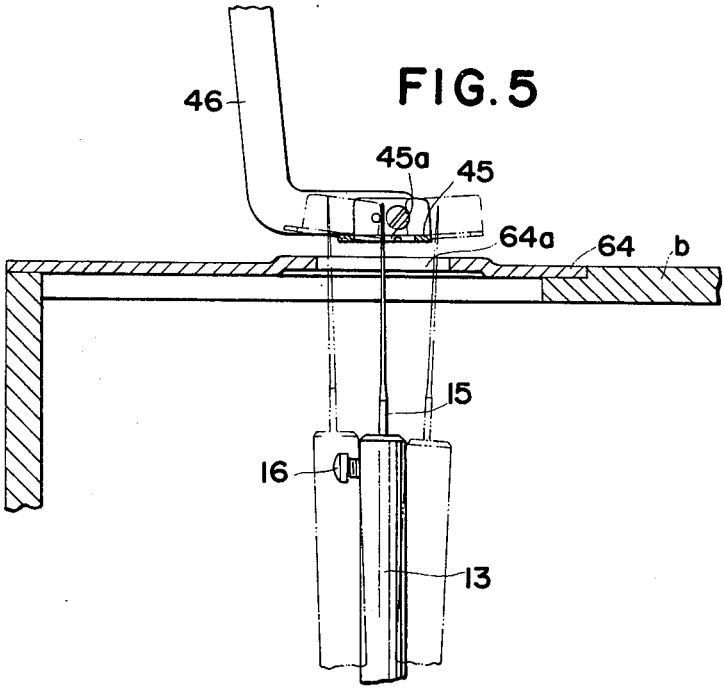
FIG. 5 is a vertical sectional front view of said bed.

In FIGS. 1 and 5, numeral 45 indicates a control plate having a circular hole 45*a* and fixed to the end of a swingable arm 46. Said swingable arm 46 is pivotally fitted at its upper part by a shaft 47 to the forward end of a lever 48 which in turn pivotally fitted to the head frame *c* by a shaft 49. To the forward end of the lever 48 there is also provided an abutment 48*a* which engages the 40*b* of the shaft 40. A tension spring 49 is provided between the lever 48 and the head frame *c*, and the intermediate portion of the swingable arm 46 engages a cam 41*a*$_1$ which is provided to the rotary ring 41*a* of the outer body 41.

Further, numeral 50 indicates a laterally movable link plate, the ends of which are respectively connected pivotally by shafts 53 and 54 to upper ends of connecting plates 51 and 52. These connecting plates are pivotally fixed at mid points thereof by shafts 55, 56 to the head frame *c*. The lower end of said connecting plate 51 is fixed by shafts 57 to an end of a link 58, and the other end of the link 58 is pivotally fitted by a shaft 59 to the aforementioned lever 22. And, to the lower end of the connecting plate 52 there is pivotally fixed an end of a link 60 by a shaft 61. The other end of the said link 60 is pivotally fixed by a shaft 62 to a middle portion of the swingable arm 46. Since the shaft 56 to which the connecting plate 52 is pivotally fixed rotates with the movement of the plate 52, the means *d* laterally moves by the supporting plate 44 which moves by a linking mechanism 63 as illustrated in FIG. 3.

Figure 4:
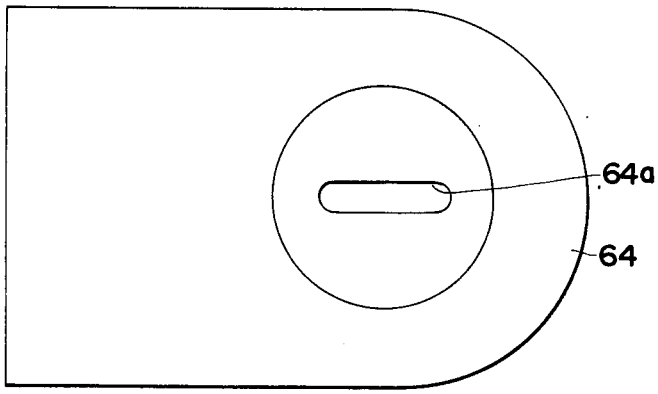
FIG. 4 is a plan view of a bed in the machine for receiving thereon a cloth to be decorated.

In FIGS. 1, 4 and 5, numeral 64 indicates a bed for cloth which is provided with a slot 64*a* and is insertedly fitted upon the table *b*. Numeral 65 indicates a stopper for the stationary ring 41*b* of the tension means, 37*a* a thread guiding ring, and 66 a spring hook.

The present machine having the above constructions operates as follows.

A spool wound up with an embroidery thread is mounted within the outer body 41 through the intermediary of the inner tension body 42 and the end of the thread is taken out from the slot 41*b*$_2$ of the stationary ring body 41*b*, while a fine under-thread wound up around a spool not shown but appropriately mounted in the machine, for example on the table *b* is passed through the loop 11, spring hook 65, eye 6*a*$_1$ of the thread feed lever 6*a*, another loop 10, ring 37*a*, and the hole of the needle 15. Nextly, a cloth is placed upon the bed 64 of table *b*, and then the grooved wheel 1*a* is started to rotate by an electric motor through the belt 2. It shall be noted that in prior to continuously moving the wheel 1*a* by the electric motor, the end of embroidery thread has to be fixed to the cloth by means of the under-thread by manually rotating the balance wheel 38*a* or by momentarily rotating the grooved wheel 1*a*.

When the grooved wheel rotates, the lower main shaft also rotates whereby the driven shaft 3 is rotated through the bevel gear 3*a*. With the rotation of the said driven shaft 3, the rotary shaft 12 rotates clockwise or counter-clockwise reciprocably through the intermediary of the operating plate 3*b* and the larger crank 4 whereby the bar 13 vertically moves up and down by the crank 17. Also with the rotation of the driven shaft 3, the under-thread feed lever 6*a* makes a lateral reciprocal movement within the slot 9, through the intermediary of the smaller crank 6. On the other hand, the rotary shaft 24 rotates by the lower main shaft 1 through the intermediary of the worm gear 1*c* fitted to said main shaft and the worm wheel meshed with the said worm gear, whereby the lever 21 laterally swings by the cam 24*a* of the shaft 24. The amount of swinging motion of said needle bar 13 about the shaft 19 may be adjusted smaller or larger, or null by laterally moving the control lever 25 by the press plate 25*a* so as to change the location of crank 32 which effects the change of the abovementioned amount of swinging motion of bar 13 or halts said motion.

With said rotation of the lower main shaft 1, the upper main shaft 38 also rotates through the intermediary of the bevel gear 1*b*, vertical shaft 39 and bevel gears 39 and 38*b*. It shall be understood that with the lateral oscillating movement of the lever 21, the link plate 50 within the head frame *c* also laterally reciprocates through the intermediary of the rod 14, lever 22, link 58 and connecting plate 51.

The rotation of upper main shaft 38 produces the rotation of the rotary tubular body 41*a* of the outer shuttle 41 by means of the worm gear 38*c*, worm wheel 40*a* and worm gear 43, whereby the embroidery thread is fed out from the tension or shuttle means through the slot 41*b*$_1$ of the stationary tubular body 41*b*, being swung right-hand and left-hand in the drawing and about said slot. On the other hand, the lateral reciprocal movement of the link plate 50 produces the lateral oscillating movement of the shuttle means *d* through the intermediary of the plate 52, shaft 56, linking mechanism 63 and support plate, while the swingable arm 46 or more particularly the control plate 45 also laterally moves through the intermediary of the connecting plate 52 and link 60, and vertically moves up and down by means of the cam 40*b*.

The stitching connections between the cloth and upper embroidery thread and between the embroidery and under-threads are explanatorily illustrated in FIGS. 10*a* and 10*b*, in which the numerals 66, 67 and 68 respectively indicate a cloth, embroidery thread and under-thread. It shall be understood from the drawing that when the under-thread is comparatively weak, it is wound up around the embroidery thread above the cloth, as illustrated in FIG. 10*a*, while when the under-thread is comparatively strong, the embroidery thread is, as illustrated in FIG. 10*b*, drawn below the back of cloth 66.

The provision of the elongated slot 64*a* to the bed 64 with the assistance of the circular opening 45*a* of the control plate 45 works to allow the needle 15 to move up and down and also laterally without any substantial resistance thereto, whereby the cloth is prevented from drawing by the needle.

What is claimed is:

1. A sewing machine comprising an upper main shaft, a lower main shaft, means for rotatably driving said upper and lower main shafts, a bed, a needle bar provided below said bed, means connecting said needle bar to be driven by said lower main shaft to effect vertical and lateral reciprocal movement thereof, a needle affixed to said needle bar for vertical and lateral movement therewith, means for feeding an under-thread to said needle, shuttle means provided above said bed for supplying therefrom an embroidery thread to said needle, said shuttle means being driven by said upper main shaft, and means pivotally connected with said needle bar and extending therefrom to above said bed for effecting lateral movement of said shuttle means in synchronism with movement of said needle, said embroidery thread being affixed with said under-thread to cloth passed through said sewing machine by operation of said needle.

2. A sewing machine according to claim 1 including control means for limiting lateral movement of said shuttle means.

3. A sewing machine according to claim 1 wherein said under-thread is supplied to said needle through a thread take-up device provided below said bed.

* * * * *